US008911045B2

(12) United States Patent
Sato

(10) Patent No.: US 8,911,045 B2
(45) Date of Patent: Dec. 16, 2014

(54) PRINTING DEVICE AND METHOD FOR CONTROLLING PRINTING DEVICE

(71) Applicant: Seiko Epson Corporation, Tokyo (JP)

(72) Inventor: Akito Sato, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/196,492

(22) Filed: Mar. 4, 2014

(65) Prior Publication Data

US 2014/0285545 A1 Sep. 25, 2014

(30) Foreign Application Priority Data

Mar. 19, 2013 (JP) ..... 2013-056205

(51) Int. Cl.
*B41J 29/38* (2006.01)
*B41J 2/165* (2006.01)

(52) U.S. Cl.
CPC ..... *B41J 2/1652* (2013.01); *B41J 2/16505* (2013.01)
USPC ..... 347/9; 347/7; 347/14; 347/23

(58) Field of Classification Search
CPC .... B41J 2/1652; B41J 2/16505; B41J 2/1707; B41J 2/1714
USPC ..... 347/7, 9, 14, 19, 23
See application file for complete search history.

(56) References Cited

U.S. PATENT DOCUMENTS 7,252,359 B2 8/2007 Udagawa
7,922,275 B2 * 4/2011 Sudo et al. ..... 347/7

FOREIGN PATENT DOCUMENTS

JP 2006-088413 A 4/2006
JP 2010-058348 A 3/2010
JP 2012-061758 A 3/2012

* cited by examiner

*Primary Examiner* — Juanita D Jackson
(74) *Attorney, Agent, or Firm* — Global IP Counselors, LLP

(57) ABSTRACT

A control section of a printing device has a print instruction receiving section configured to receive print instructions to a printing medium including a plurality of pages, and an ink use analyzing section configured to analyze image forming dots formed on each page and to output each of ink use information and ink non-use information for each page. The control section is configured to acquire the ink non-use information of a given first page of continuous pages of the plurality of pages and the ink use information of a second page that is a next page of the first page, and to determine to use ink, that is not used in the first page shown by the ink non-use information and is used in the second page shown by the ink use information, at least for flushing dots to the first page.

7 Claims, 6 Drawing Sheets

PRINTING DEVICE AND METHOD FOR CONTROLLING PRINTING DEVICE

CROSS-REFERENCE TO RELATED APPLICATIONS

This application claims priority to Japanese Patent Application No. 2013-056205 filed on Mar. 19, 2013. The entire disclosure of Japanese Patent Application No. 2013-056205 is hereby incorporated herein by reference.

BACKGROUND

1. Technical Field

The present invention relates to a printing device and a method for controlling a printing device.

2. Background Technology

An inkjet printer is known in which printing is conducted by feeding paper in one direction, moving a head having a plurality of nozzles back and forth in another direction perpendicular to the one direction, and ejecting ink of each color from each of the nozzles. In the inkjet printer, when a state in which ink is not ejected from the nozzles lasts, there are cases in which the moisture of ink evaporates from the openings of the nozzles so as to increase the viscosity of ink. When the viscosity of ink is increased, there are cases in which clogging of the nozzles occurs and the ejection operation of ink becomes unstable. In order to avoid these situations, as shown in Japanese Laid-open Patent Publication No. 2010-58348, for example, an apparatus has been proposed to prevent or solve clogging of the nozzles. In such an apparatus, an ejection operation (flushing process) for ejecting ink which does not contribute to image formation is conducted from each of nozzles to a feed belt for feeding paper. Also, a flushing process in which ink is ejected to paper while being dispersed so as not to be observed has been known. For example, in a case in which a plurality of pages in one job include both color printing and monochrome printing, flushing (between-paper flushing) for ejecting color ink to a feed belt is conducted at a timing when printing to a prescribed page is completed and printing to the next page is started so as not to increase the viscosity of ink in a nozzle for ejecting color ink at the time of continuing monochrome printing. Also, even in a case of monochrome printing, the viscosity of color ink in a nozzle can be prevented from increasing by conducting flushing of color ink on paper (on-paper flushing).

SUMMARY

However, during printing of a plurality of pages in one job, the printing is interrupted by conducting between-paper flushing between pages. Thus, the throughput of the printing is deteriorated. Further, regardless of whether color printing or monochrome printing is conducted, the consumption of color ink is increased and the cost for printing is increased by conducting on-paper flushing of color ink. The present invention has been made to address the above-described problems, and the object of the present invention is to efficiently conduct flushing and control the ink amount consumed by flushing.

The present invention has been made to solve at least part of the above-described problems, and the present invention can be implemented as the following embodiment or aspects.

According to the present aspect, a printing device includes at least one head, a driving mechanism, and a control section. At least one head has a plurality of nozzles configured and arranged to eject a plurality of kinds of ink. The driving mechanism is configured and arranged to move at least one of a printing medium and the head so as to relatively change positions of the printing medium and the head. The control section is configured to control operation of forming image forming dots for printing an image designated as a print target and flushing dots other than the image forming dots on the printing medium by ejecting the ink from each of the nozzles while relatively changing the positions of the printing medium and the head by the driving mechanism. The control section has a print instruction receiving section configured to receive print instructions to the printing medium including a plurality of pages, and an ink use analyzing section configured to analyze the image forming dots formed on each page of the plurality of pages and to output each of ink use information and ink non-use information for each page, the ink use information and the ink non-use information showing which ink is used and which ink is not used among the plurality of kinds of ink in each page. When the print instruction receiving section receives the print instructions over the plurality of pages, the control section is configured to acquire the ink non-use information of a given first page of continuous pages of the plurality of pages and the ink use information of a second page that is a next page of the first page from the ink use analyzing section, and to determine to use ink, that is not used in the first page shown by the ink non-use information and is used in the second page shown by the ink use information, at least for the flushing dots to the first page.

With this configuration, by analyzing the image forming dot, the ink non-use information of a first page of continuous pages and the ink use information of a second page to be printed next to the first page are acquired, and ink that is not used in the first page and is used in the second page is used at least as the flushing ink to the first page. In this manner, even if the ink is not used in the first page, if the ink is used in the second page, the ink is used as the flushing ink to the first page. Consequently, clogging in the nozzle for ejecting ink used for the second page due to increase in the viscosity can be solved in the first page that is a previous page to the second page, and the print quality of the second page will not be deteriorated.

In the printing device according to the above-described aspect, preferably, when the print instruction receiving section receives the print instructions over the plurality of pages, the control section is further configured to acquire the ink use information of the first page and the ink non-use information of the second page from the ink use analyzing section, and to determine not to use ink, that is not used in the second page shown by the ink non-use information, for the flushing dots to the first page in a case in which the ink used in the first page and the ink used in the second page shown by the ink use information are the same, and to determine to use ink, that is not used in the first page shown by the ink non-use information and is used in the second page shown by the ink use information, at least for the flushing dots to the first page in a case in which the ink used in the first page and the ink used in the second page shown by the ink use information are not the same.

With this configuration, in a case in which the ink used in the first page and the ink used in the second page shown by the ink use information are the same, ink that is not used in the second page shown by the ink non-use information is not used for the flushing dot to the first page. Since clogging in the nozzle for ejecting the ink due to increase in the viscosity does not need to be solved in the first page that is a previous page to the second page, ink that is not used in the second page is not used as the flushing ink to the first page. Consequently, the ink amount to be consumed can be reduced.

In the printing device according to the above-described aspect, the plurality of kinds of ink preferably includes achromatic ink and chromatic ink, and the image forming dots are formed on the first page by the achromatic ink and not by the chromatic ink.

In the printing device according to the above-described aspect, preferably, in a case in which there is ink that is not ejected from the nozzles for a prescribed period of time in the continuous pages among the plurality of kinds of ink, the control section is configured to determine to use the ink, that is not ejected from the nozzles for the prescribed period of time, at least for the flushing dots to the first page irrespective of the ink use information and the ink non-use information from the ink use analyzing section.

With this configuration, ink that is not ejected from the nozzle for a prescribed period of time is used at least for the flushing dot to the first page. Consequently, since ink that is not used does not remain in the nozzle for a prescribed period of time, it is possible to prevent the viscosity from increasing as time passes.

In the printing device according to the above-described aspect, preferably, the plurality of kinds of ink includes cyan ink, magenta ink, and yellow ink, and the control section is configured to cause the flushing dots to be formed by superimposing the cyan ink, the magenta ink, and the yellow ink at the same position in a case in which the control section determines to use the cyan ink, the magenta ink, and the yellow ink for the flushing dots.

With this configuration, the cyan ink, the magenta ink, and the yellow ink ejected to be superimposed at the same position is observed as black color by a subtraction color mixing action, and the flushing dot is observed as black color in any mode. Therefore, even in a case in which both printing with chromatic ink and printing with achromatic ink are conducted in a plurality of pages, a sense of discomfort will not be given.

In the printing device according to the above-described aspect, preferably, the control section is configured to make a dot pattern of the flushing dots formed on the first page and a dot pattern of the flushing dots formed on the second page the same at least in a prescribed area of the first and second pages.

With this configuration, the dot patterns are the same regardless of whether the ink for forming the flushing dot is chromatic ink or achromatic ink. Therefore, even in a case in which both printing with chromatic ink and printing with achromatic ink are conducted in a plurality of pages, a sense of discomfort will not be given.

A method according to another aspect is a method for controlling a printing device including at least one head having a plurality of nozzles for ejecting a plurality of kinds of ink, a driving mechanism configured and arranged to move at least one of a printing medium and the head so as to relatively change positions of the printing medium and the head, and a control section configured to control operations of forming image forming dots for printing an image designated as a print target and flushing dots other than the image forming dot on the printing medium by ejecting the ink from each of the nozzles while relatively changing the positions of the printing medium and the head by the driving mechanism. The method for controlling a printing device includes: receiving print instructions to the printing medium including a plurality of pages; and analyzing ink use by analyzing the image forming dots formed on each page of the plurality of pages and outputting each of ink use information and ink non-use information for each page, the ink use information and the ink non-use information showing which ink is used and which ink is not used among the plurality of kinds of ink in each page. The analyzing the ink use includes, when receiving the print instructions over a plurality of pages, acquiring the ink non-use information of an given first page of continuous pages of the plurality of pages and the ink use information of a second page that is a next page of the first page, and determining to use ink, that is not used in the first page shown by the ink non-use information and is used in the second page shown by the ink use information, at least for the flushing dots to the first page.

With the method for controlling a printing device according to the above-described aspect, by analyzing the image forming dot, the ink non-use information of a first page of continuous pages and the ink use information of a second page to be printed next to the first page are acquired, and ink that is not used in the first page and is used in the second page is used at least as the flushing ink to the first page. In this manner, even if the ink is not used in the first page, if the ink is used in the second page, the ink is used as the flushing ink to the first page. Consequently, clogging in the nozzle for ejecting ink used for the second page due to increase in the viscosity can be solved in the first page that is a previous page to the second page, and the print quality of the second page will not be deteriorated.

BRIEF DESCRIPTION OF THE DRAWINGS

Referring now to the attached drawings which form a part of this original disclosure.

DETAILED DESCRIPTION OF EXEMPLARY EMBODIMENTS

Hereinafter, an embodiment of the present invention will be explained with reference to the drawings.

Figure 1:
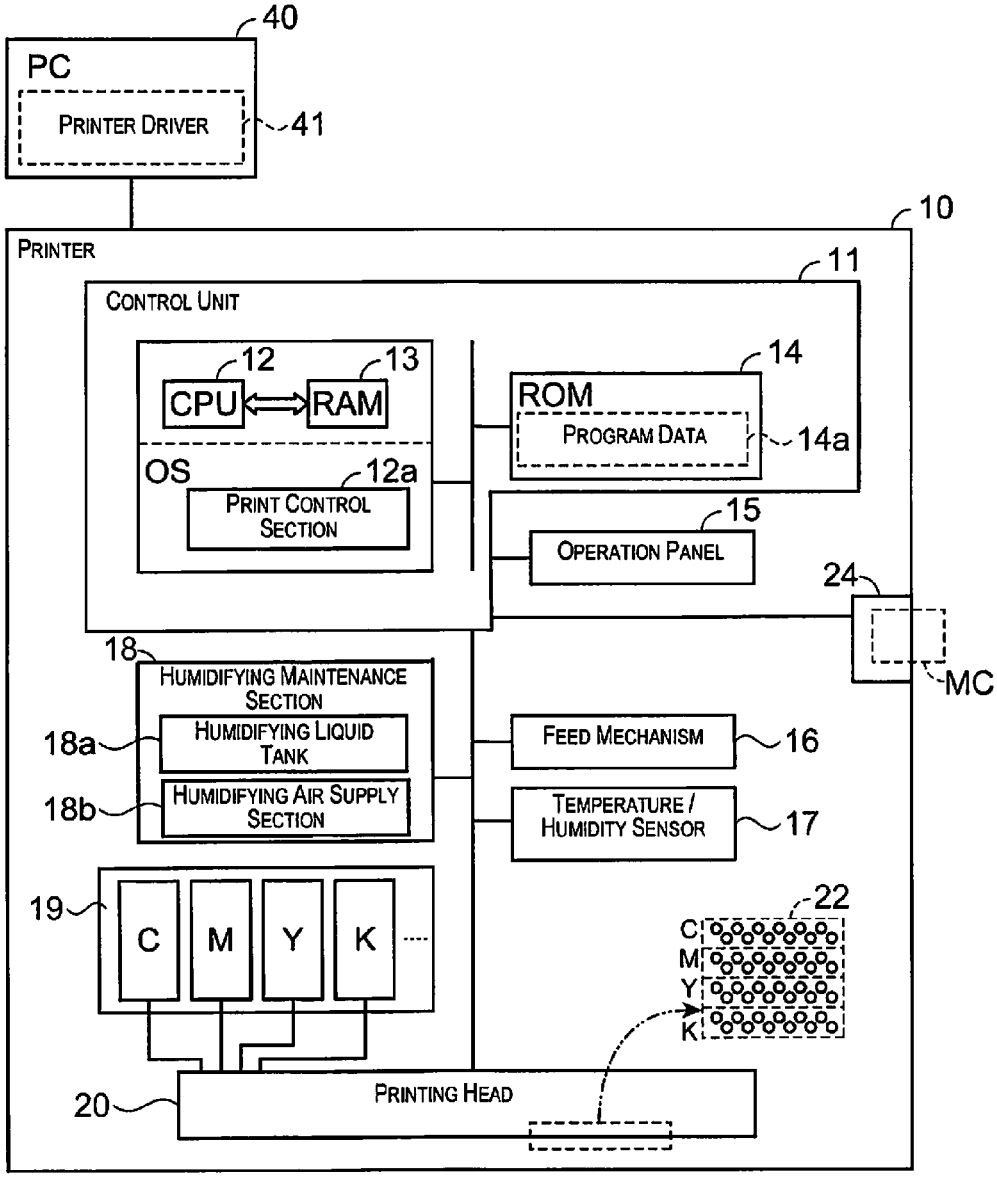
FIG. 1 is a diagram that schematically shows a hardware configuration and a software configuration of a printing device according to an embodiment of the present invention.

Hereinafter, an embodiment of the present invention will be explained with reference to the drawings. FIG. 1 schematically shows a hardware configuration and a software configuration of a personal computer (PC) 40 and a printer 10. The printer 10 corresponds to a printing device. However, a system that includes the PC 40 and printer 10 can be considered as the printing device. The printer 10 has a control unit 11 for controlling a liquid ejection process (print process). In the control unit 11, a CPU 12 opens program data 14*a* such as firmware stored in a memory such as a ROM 14 in a RAM 13 and conducts calculation in accordance with the program data 14*a* under an OS, so as to control each function of a print control section 12*a* or the like.

The print control section 12*a* has a function of controlling each function of the printer 10. For example, the print control section 12*a* receives print instructions of image data (print instruction receiving section) from a storage medium or the like inserted from outside into the PC 40 or the printer 10, and generates print data from the image data whose instructions have been received. Then, printing can be conducted based on the generated print data. The storage medium refers to a memory card MC, for example. The memory card MC is inserted into a slot portion 24 that is formed in a case body of the printer 10. The print control section 12*a* can input image data from various external devices such as a scanner connected to the printer 10 in a wired or wireless manner, a digital still camera, a cell phone terminal, or a server connected via a network. The image data shows an image (print target image) that a user arbitrarily designates as a print target. For example, the image data is bit map data, RGB data that has tones of a color system of red, green, and blue (R, G, and B) for each pixel, or ink amount data that has tones of an ink color system (cyan (C), magenta (M), yellow (Y), black (K), and the like) used by the printer 10 for each pixel. The control section 12*a* conducts a resolution conversion process, a conversion process of the color system (color conversion process), a halftone process, or the like to the bit map data, so as to generate print data. The print data is data for each kind of ink in which ejection (dot on) and non-ejection (dot off) of liquid (ink) is specified for each pixel.

The print control section 12*a* receives print data generated from image data by a printer driver 41 from the PC 40 so as to conduct printing based on the received print data. The printer driver 41 is installed in the PC 40. Alternatively, the print control section 12*a* receives PDL data expressed by a prescribed page description language (PDL) from the printer driver 41 so as to conduct printing of a print target image based on the PDL data. In this case, the print control section 12*a* converts the PDL data into an intermediate code by analyzing the PDL data, and generates bit map data on the RAM 13 by opening the intermediate code. The print control section 12*a* generates print data from the bit map data.

The printer 10 has a cartridge 19 for each of a plurality of kinds of liquid. In the example of FIG. 1, the cartridge 19 is installed corresponding to each ink of CMYK. However, the specific kind or number of the liquid used by the printer 10 is not limited. For example, cartridges 19 for various kinds of ink such as light cyan, light magenta, orange, green, gray, light gray, white, metallic ink, or precoat liquid or the like that is a chemical solution for causing aggregation or deposit of a coloring component of each ink can further be provided. Also, the printer 10 has a printing head 20 for selectively ejecting (injecting) liquid, supplied from each cartridge 19, from a great number of nozzles 22 for liquid ejection. The printing head 20 in the present embodiment is a so-called line head that has an elongated shape. Incidentally, FIG. 1 shows the position of the nozzles 22 in the printing head 20, but does not show the arrangement configuration of the nozzles 22. According to the present embodiment, in the printing head 20, a nozzle line is formed by arranging a plurality of short heads 21 in a zigzag pattern and providing the nozzles 22 in each head 21. However, the arrangement of the nozzle line is not limited. The arrangement of the nozzles 22 for each color may be configured as a plurality of nozzle lines that are displaced in a longitudinal direction with a prescribed pitch as shown in FIG. 1, or may be configured as a single nozzle line lined up along the longitudinal direction.

The print control section 12*a* generates a driving signal for driving the printing head 20, a feed mechanism 16, or the like based on the print data. A piezoelectric element is provided for each nozzle 22 in the printing head 20 so as to eject liquid drops (dots) from the nozzle 22. The piezoelectric element is deformed when the driving signal is applied, and causes dots to be ejected from the corresponding nozzle 22. The feed mechanism 16 is a driving mechanism that relatively changes the position of paper P and the printing head 20, and has a motor (not shown in the drawings), rollers 16*a*, 16*b*, and 16*c* (see FIG. 2) that rotate by the motor, and the like. The feed mechanism 16 feeds a printing medium along a prescribed feed direction by driving control using the print control section 12*a*. When ink is ejected from each nozzle 22 of the printing head 20 to the printing medium that has reached a prescribed feed position, dots adhere onto the printing medium under feeding, and a print target image is reproduced on the printing medium based on the print data. Here, although paper P is conceived as the printing medium in the present embodiment, the printing medium is not limited to paper. The printer 10 has an operation panel 15. The operation panel 15 includes a display section that uses, for example, a liquid crystal panel, a touch panel, various kinds of buttons, and keys. The touch panel, the buttons, and the keys are formed on the display section. The operation panel 15 displays a user interface (UI) screen on the display section or receives input of the printing conditions or the like from a user. The printing conditions can include the kind of the paper P, the direction of the printing, the print resolution, and the like.

In addition to a print operation from the operation panel 15, it is also possible to cause the printer 10 to print a print target image by operating the PC 40. A user inputs print instructions or printing conditions of a print target image through a UI screen presented by the printer driver 41 on a display of the PC 40. Also, the information showing the printing conditions that has been input in this manner is transmitted from the PC 40 to the printer 10 together with the print data. Also, the printer 10 has a temperature/humidity sensor 17 that acquires temperature or humidity, and a humidifying maintenance section 18. The humidifying maintenance section 18 has a humidifying liquid tank 18*a* for storing humidifying liquid that includes a non-volatile component, and a humidifying air supply section 18*b* for supplying air, humidified by the humidifying liquid stored in the humidifying liquid tank 18*a*, to a sealed space facing an opening of the nozzle 22. The humidifying maintenance section 18 controls increase in the viscosity (increased viscosity) of the ink in the nozzle 22.

Figure 2:
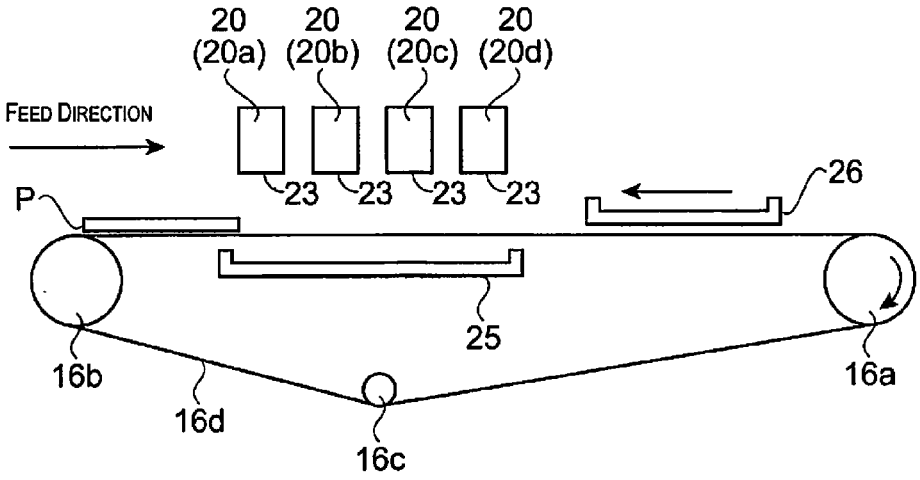
FIG. 2 is a diagram that shows an internal configuration of a printer according to an embodiment of the present invention.

FIG. 2 illustrates a part of an internal configuration of the printer 10 in a simplified manner from view in the longitudinal direction of the printing head 20. The printing head 20 has a plurality of line heads 20*a*, 20*b*, 20*c*, and 20*d* for each kind of ink. The line heads 20*a*, 20*b*, 20*c*, and 20*d* have the same configuration. For example, the line head 20*a* can execute ejection of cyan ink (C ink), the line head 20*b* can execute ejection of magenta ink (M ink), the line head 20*c* can execute ejection of yellow ink (Y ink), and the line head 20*d* can execute ejection of black ink (K ink), respectively. The line heads 20*a*, 20*b*, 20*c*, and 20*d* are fixed in prescribed positions in the printer 10, for example, in a state in which the line heads 20*a*, 20*b*, 20*c*, and 20*d* are in parallel with each other in the longitudinal direction. Hereinafter, the "longitudinal direction" always refers to a longitudinal direction of each of the line heads 20*a*, 20*b*, 20*c*, and 20*d* unless it is described otherwise.

As shown in FIG. 2, an endless belt 16*d* that moves by being caught with the rotating rollers 16*a*, 16*b*, and 16*c* is provided in a position opposed to a nozzle opening surface 23 as the feed mechanism 16. The paper P is fed in a feed direction by being placed on the endless belt 16*d*, and undergoes ejection of ink from the nozzle 22 when passing below the nozzle opening surface 23. The longitudinal direction of the line heads 20*a*, 20*b*, 20*c*, and 20*d* is a direction that intersects with the feed direction of the paper P, and the line heads 20*a*, 20*b*, 20*c*, and 20*d* are arranged at prescribed intervals in the feed direction. "Intersection" described herein refers to perpendicular intersection. However, perpendicular intersection described in the present specification does not mean an exact angle (90°) alone, and includes an error of the angle to an extent that is accepted in terms of the quality of the product.

In the present embodiment, mainly, the explanation is continued based on an assumption that the printing head 20 is fixed and the paper P is fed by the feed mechanism 16. However, it may be configured such that the printing head 20 moves by a carriage with respect to the paper P that does not move (or temporarily stops moving). Specifically, it is sufficient that at least one of the paper P and the printing head 20 moves and the position of the paper P and the printing head 20 relatively changes along a prescribed direction. In the case of moving the printing head 20, the longitudinal direction is a direction that intersects with the direction for relatively changing the position of the paper P and the printing head 20. The printing head 20 is not limited to the line head. That is, another embodiment is possible in which printing is conducted by moving the head having a plurality of nozzles back and forth in a scanning direction perpendicular to the feed direction (sub scanning direction) of the paper P.

In the present embodiment, the printer 10 can execute flushing. Flushing refers to a specific operation for forming dots other than dots for printing a print target image by ejecting ink from the nozzles 22 so as to control increase in the viscosity of ink in the nozzles 22. Dots for printing a print target image (dots constituting print data) can be called as image forming dots, and dots other than the image forming dots can be called as flushing dots. Here, ink drops by the flushing dots have very small volumes. Therefore, even if the ink drops land on the paper P, the ink drops cannot be observed with the naked eye.

Flushing includes "first flushing" that conducts ink ejection to a place other than the paper P, and "second flushing" that conducts ink ejection to the paper P. In the present embodiment, the print control section 12*a* has a first flushing control section (not shown in the drawings) that controls the first flushing and a second flushing control section 110 (FIG. 3) that controls the second flushing. The print control section 12*a* judges increase in the viscosity based on ejection frequency and the like of ink. In a case in which the print control section 12*a* determines that flushing needs to be executed, the print control section 12*a* instructs the first flushing control section or the second flushing control section 110 (FIG. 3) to execute flushing, and controls the execution of flushing. The first flushing uses, for example, a waste solution cap 26. The waste solution cap 26 moves to below the nozzle opening surface 23 so as to cover the nozzle opening surface 23 at a timing of execution of the first flushing in response to control by the control unit 11. The printing head 20 ejects ink from each nozzle 22 as the first flushing in a state where the nozzle opening surface 23 is covered with the waste solution cap 26. Ink ejected in this manner is stored in the waste solution cap 26. The waste solution cap 26 returns to a prescribed original position after completion of the first flushing in response to control by the control unit 11.

Also, as an example of the first flushing, the printer 10 can conduct flushing to the endless belt 16*d*. In this case, a waste solution saucer 25 for receiving a waste solution is provided in a position that is opposed to the nozzle opening surface 23 in a state in which the endless belt 16*d* is sandwiched. For example, the endless belt 16*d* can be formed in a mesh shape such that ink ejected onto the belt surface can pass therethrough. As the first flushing, the printing head 20 ejects ink from each nozzle 22 at a prescribed timing when the paper P does not exist below the nozzle opening surface 23. Ink ejected in this manner passes through the endless belt 16*d* and is stored in the waste solution saucer 25. Incidentally, the printer 10 can be provided with a wiper or the like to clean the belt surface of the endless belt 16*d* that becomes dirty when ink ejected by the first flushing passes therethrough. Here, when the first flushing is executed, the waste solution saucer 25 and the waste solution cap 26 need to be moved, and the throughput of a print process will be deteriorated. Therefore, the print control section 12*a* instructs execution of the first flushing basically at a timing between a page and a page to be printed. Sometimes the print control section 12*a* instructs execution of the first flushing between pages so as to control the increase in the viscosity even when one print job is being executed. Then the throughput of the printing will be deteriorated by executing the first flushing to a page that is in the middle of a plurality of pages.

The second flushing is executed when a print target image is printed based on the control by the second flushing control section 110. The second flushing control section 110 artificially generates flushing data that expresses a dot pattern for repeatedly ejecting flushing dots at prescribed distance intervals in pixel lines constituting a print target image that are in parallel with each other in the feed direction. The second flushing control section 110 generates ejection data by superimposing (synthesizing) the flushing data and the print data that shows a print target image, and causes the printing head 20 to execute an ink ejection operation based on the generated ejection data. As a result of this, dots are formed on the paper P corresponding to each pixel in which dot on can be obtained by OR in the results of the superimposing. Therefore, clogging of the nozzles 22 can be prevented or solved without causing the throughput of printing to be deteriorated by conducting the second flushing at the same time when the printing of a print target image is conducted. Incidentally, the first flushing is referred to as "mechanical flushing" or "between-paper flushing", and the second flushing is referred to as "on-paper flushing".

Figure 3:
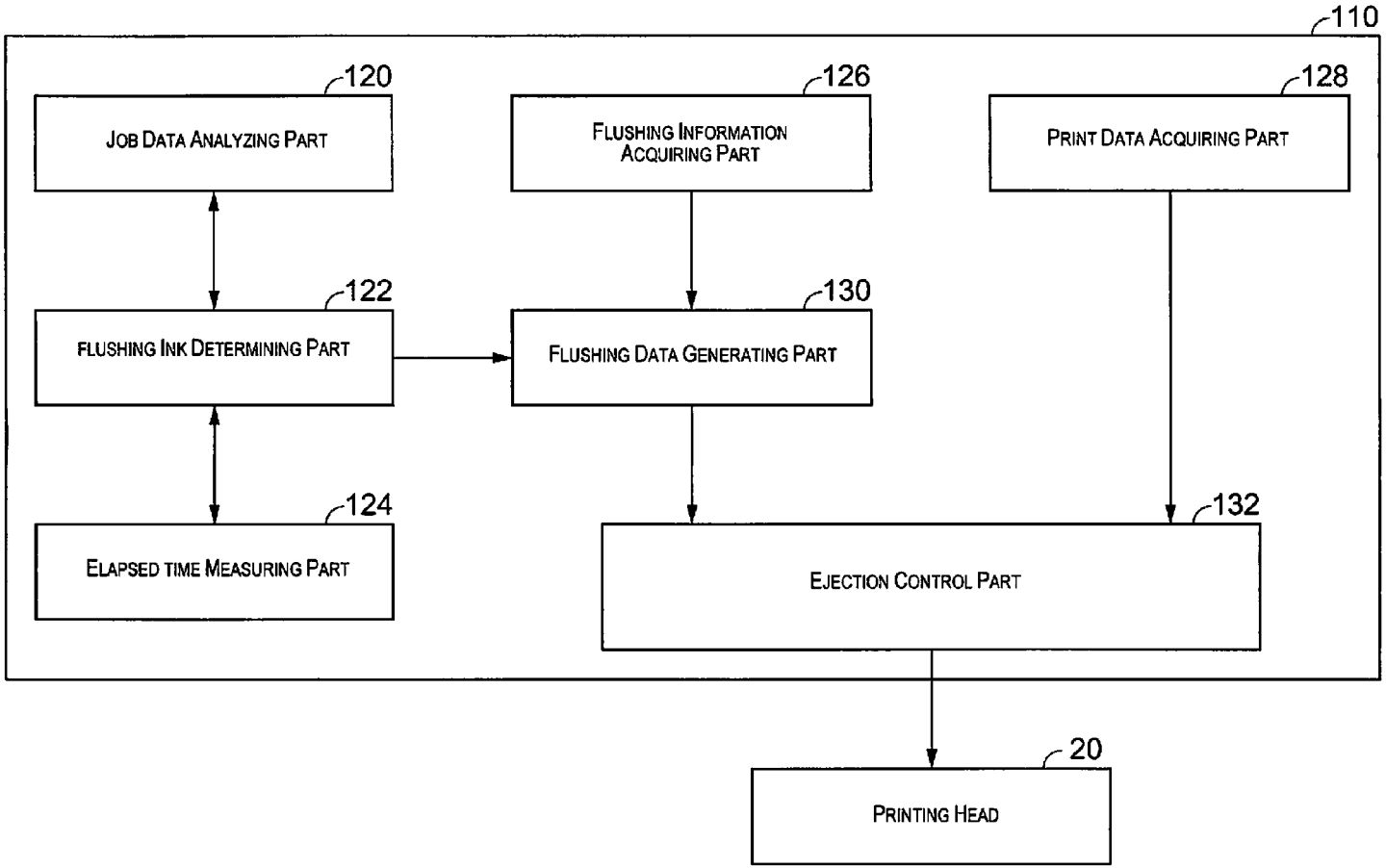
FIG. 3 is a diagram that shows a functional configuration of a second flushing control section.

FIG. 3 shows a functional configuration of the second flushing control section 110. The second flushing control section 110 includes a job data analyzing part 120, a flushing ink determining part 122, an elapsed time measuring part 124, a flushing information acquiring part 126, a print data acquiring part 128, a flushing data generating part 130, and an ejection control part 132. The job data analyzing part 120 has a function of analyzing print job data to be printed by the printer 10 based on instructions from the flushing ink determining part 122. In the present embodiment, a print job is constructed of a plurality of pages (N pages), and instructions are issued such that each page is sequentially printed. The job data analyzing part 120 analyzes print job data of a prescribed page instructed by the flushing ink determining part 122, and determines whether it is color printing for printing the print target image of the prescribed page using color ink or monochrome printing for printing using only the K ink. Print information that shows the determination results is transmitted to the flushing ink determining part 122. In the present embodiment, color ink refers to the C ink, the M ink, and the Y ink that are chromatic ink. Color printing refers to printing using the C ink, the M ink, and the Y ink that are chromatic ink, and the K ink that is achromatic ink. Monochrome printing refers to printing using only the K ink that is achromatic ink. The job data analyzing part 120 constitutes the ink use analyzing section that analyzes an image forming dot and outputs each of ink use information and ink non-use information for each page. The ink use information and the ink non-use information show ink that is used and ink that is not used in each page. The elapsed time measuring part 124 has a function of measuring the elapse of time. In the present embodiment, the elapsed time measuring part 124 is reset when the C ink, the M ink, and the Y ink are ejected from each nozzle so as to measure the elapsed time starting when the C ink, the M ink, and the Y ink are used last. Information on the measured elapsed time is set such that it can be referred by the flushing ink determining part 122.

The flushing ink determining part 122 has a function of determining ink (flushing ink) to be used for a flushing dot ejected to form a dot pattern based on the print information acquired from the job data analyzing part 120 and the time information referred from the elapsed time measuring part 124. In the present embodiment, the print information is information of a $J^{th}$ page (first page) to be printed from now and information of a $(J+1)^{th}$ page (second page) to be printed next, and each is acquired through the job data analyzing part 120. As a result of acquiring the information, in a case in which both of an image of the $J^{th}$ page (first image) and an image of the $(J+1)^{th}$ page (second image) are printed by monochrome printing using only the K ink that is achromatic ink and the elapsed time measured by the elapsed time measuring part 124 does not exceed a prescribed period of time, the flushing ink determining part 122 determines that the flushing ink ejected as a flushing dot to the $J^{th}$ page is the K ink that is achromatic ink. That is, in a case in which the ink used in the first page and the ink used in the second page are the same, ink that is not used in the second page is not used for the flushing dot to the first page. Here, the ink used in the first page and the ink used in the second page are the same K ink. Therefore, the C ink, the M ink, and the Y ink that are not used in the second page are not used for the flushing dot to the first page. However, in a case in which the elapsed time measured by the elapsed time measuring part 124 exceeds a prescribed period of time, the C ink, the M ink, and the Y ink are used for the flushing dot to the first page. This will be described later.

Figure 4:
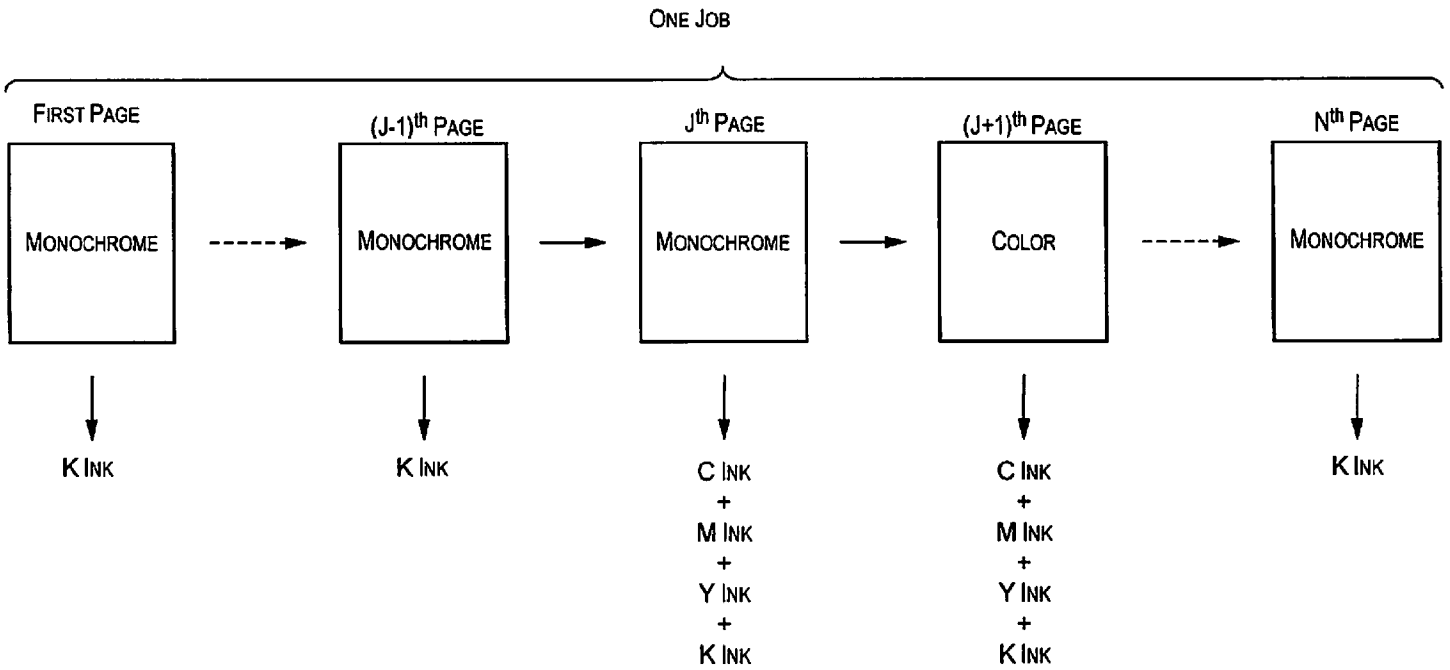
FIG. 4 is a diagram that shows an example of a page configuration of a job.
Figure 5:
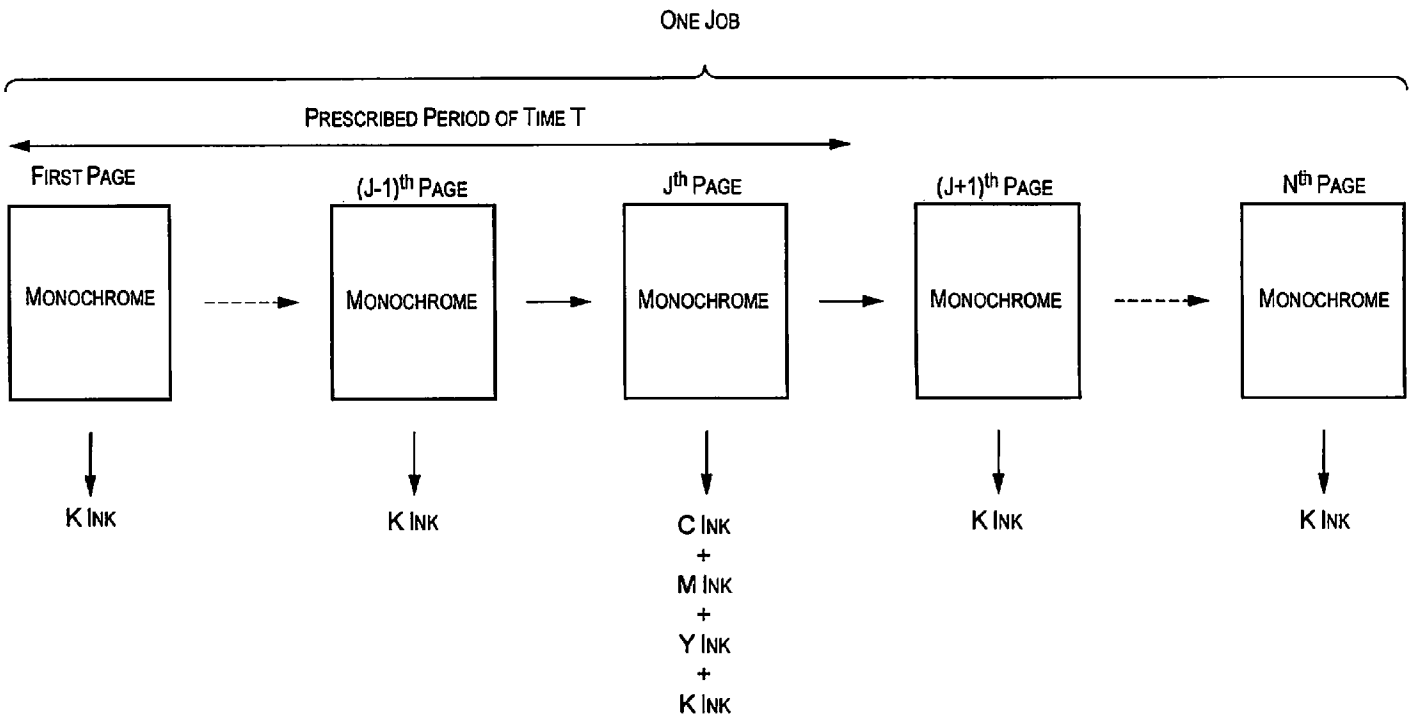
FIG. 5 is a diagram that shows an example of a page configuration of a job.

On the other hand, as shown in an example of a page configuration of a print job of FIG. 4, in a case in which monochrome printing using only the K ink that is achromatic ink is conducted to the $J^{th}$ page and color printing using the C ink, the M ink, and the Y ink that are chromatic ink and the K ink that is achromatic ink is conducted to the $(J+1)^{th}$ page, the flushing ink determining part 122 determines the C ink, the M ink, and the Y ink that are chromatic ink, and the K ink as the flushing ink ejected as a flushing dot to the $J^{th}$ page. That is, in a case in which the ink used in the first page and the ink used in the second page are not the same, ink that is not used in the first page and is used in the second page is used at least for the flushing dot to the first page. Here, since the ink used in the first page is the K ink and the ink used in the second page is the C ink, the M ink, the Y ink, and the K ink, the ink used in the first page and the ink used in the second page are not the same. Therefore, the C ink, the M ink, and the Y ink that are not used in the first page and are used in the second page are used at least for the flushing dot to the first page. In addition, as shown in an example of a page configuration of a print job of FIG. 5, in a case in which monochrome printing is conducted to the $J^{th}$ page, and the C ink, the M ink, and the Y ink are not used for a prescribed period of time, the flushing ink determining part 122 determines the C ink, the M ink, the Y ink, and the K ink as the flushing ink ejected as a flushing dot to the $J^{th}$ page. Here, in a case in which color printing is conducted to the $J^{th}$ page, the flushing ink determining part 122 determines the C ink, the M ink, the Y ink, and the K ink as the flushing ink irrespective of the $(J+1)^{th}$ page.

Here, although it is not shown in the drawings, an explanation will be made on a case in which color printing with the C ink, the M ink, and the Y ink without using the K ink (color printing without K ink), and color printing with the C ink, the M ink, the Y ink and the K ink using the K ink are conducted to a plurality of pages. In this example, color printing with the C ink, the M ink, and the Y ink without using the K ink is conducted to the $(J-2)^{th}$ page, the $(J-1)^{th}$ page, and the $J^{th}$ page, and color printing with the C ink, the M ink, the Y ink and the K ink is conducted to the $(J+1)^{th}$ page. In this case, the C ink, the M ink, and the Y ink are used to form flushing dots of the $(J-2)^{th}$ page and the $(J-1)^{th}$ page. This means that the K ink that is not used in the $(J-1)^{th}$ page is not used for the flushing dot to the $(J-2)^{th}$ page because the ink used in the $(J-2)^{th}$ page and the ink used in the $(J-1)^{th}$ page are the same due to color printing without K ink. Similarly, the K ink that is not used in the $J^{th}$ page is not used for the flushing dot to the $(J-1)^{th}$ page because the ink used in the $(J-1)^{th}$ page and the ink used in the $J^{th}$ page are the same. On the other hand, the K ink is used in addition to the C ink, the M ink, and the Y ink for the flushing dot of the $J^{th}$ page. Since color printing without K ink using the C ink, the M ink, and the Y ink is conducted to the $J^{th}$ page, and color printing using the C ink, the M ink, the Y ink, and the K ink is conducted to the $(J+1)^{th}$ page, the ink used in the $J^{th}$ page and the ink used in the $(J+1)^{th}$ page are not the same. Therefore, this means that the K ink that is not used in the $J^{th}$ page and is used in the $(J+1)^{th}$ page is used at least for the flushing dot to the $J^{th}$ page.

The explanation will be continued back to the present embodiment in which monochrome printing and color printing are conducted. In the present embodiment, in a case in which the elapsed time measured by the elapsed time measuring part 124 exceeds a prescribed period of time, the C ink, the M ink, and the Y ink are used for the flushing dot to the first page. The prescribed period of time is a period of time in which it is determined that flushing is necessary in terms of increase in the viscosity of the C ink, the M ink, and the Y ink, and is stored in the ROM 14 or the like in advance. The flushing information acquiring part 126 has a function of acquiring flushing information for generating flushing data so as to conduct the second flushing. In the present embodiment, the flushing information includes information regarding a dot pattern that causes flushing dots to be repeatedly ejected at prescribed distance intervals, and such information is stored in the ROM 14 or the like. The flushing data acquired by the flushing information acquiring part 126 is transmitted to the flushing data generating part 130. The flushing data generating part 130 has a function of generating flushing data to eject flushing ink determined by the flushing ink determining part 122 based on the flushing information. Here, regardless of whether the flushing data is flushing data generated in a case in which the K ink is determined or flushing data generated in a case in which the C ink, the M ink, the Y ink, and the K ink are determined, the dot patterns shown by both the flushing data are the same in a prescribed area of a page. The flushing data generating part 130 transmits the generated flushing data to the ejection control part 132.

Figure 6:
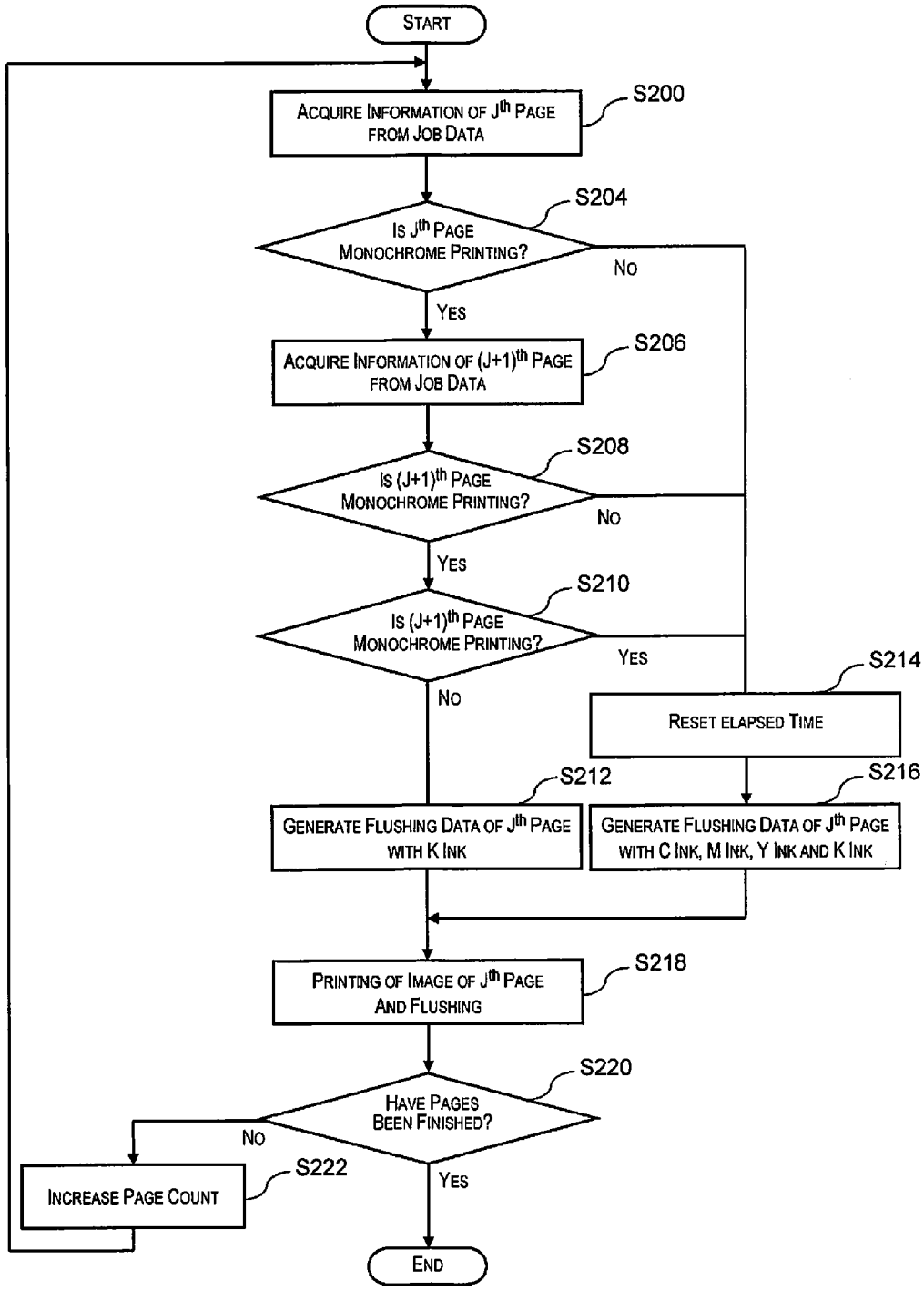
FIG. 6 is a flow chart that shows a second flushing process.

The print data acquiring part 128 acquires print data showing a print target image of the $J^{th}$ page from print job data, and transmits the acquired print data to the ejection control part 132. The ejection control part 132 has a function of superimposing (synthesizing) the flushing data and the print data of the $J^{th}$ page, and causing the printing head 20 to execute ink ejection based on the superimposed data. By executing this function, dots of the $J^{th}$ page are formed on the paper P corresponding to each pixel in which dot on can be obtained by OR in the results of the superimposing. Therefore, clogging of the nozzles 22 can be prevented or solved at the same time when the printing of a print target image is conducted. Here, the C ink, the M ink, the Y ink and the K ink are ejected to be superimposed at the same position. Therefore, a dot formed on the paper P is observed as black color by a subtraction color mixing action of cyan, magenta, and yellow. FIG. 6 is a flow chart that shows a print process (control method) based on job data that instructs printing of a plurality of pages. First, the CPU 12 acquires information of the $J^{th}$ page from job data received in the print instruction receiving step (step S200). Next, the CPU 12 judges whether or not the print target image of the $J^{th}$ page is monochrome printing based on the acquired information (step S204) <ink use analyzing step>.

Here, in a case in which the $J^{th}$ page is monochrome printing (Yes in step S204), the CPU 12 acquires information of the $(J+1)^{th}$ page from the job data (step S206). Next, the CPU 12 judges whether or not the print target image of the $(J+1)^{th}$ page is monochrome printing based on the acquired information (step S208). Here, in a case in which the $(J+1)^{th}$ page is monochrome printing (Yes in step S208), the CPU 12 judges whether or not the elapsed time will exceed the prescribed period of time when printing of the $J^{th}$ page is conducted (step S210). Here, in a case in which the elapsed time will not exceed the prescribed period of time (No in step S210), the CPU 12 generates flushing data of the $J^{th}$ page with the K ink (step S212) and proceeds to step S218. In a case in which the $J^{th}$ page is color printing in step S204 (No in step S204), in a case in which the $(J+1)^{th}$ page is color printing in step S208 (No in step S208), and in a case in which the elapsed time will exceed the prescribed period of time (Yes in step S210), the CPU 12 resets the elapsed time (step S214) and proceeds to step S216. In step S216, the CPU 12 generates flushing data of the $J^{th}$ page with the C ink, the M ink, the Y ink and the K ink, and proceeds to step S218. In step S218, the CPU 12 prints the print target image of the $J^{th}$ page to the paper P and executes the second flushing to the paper P based on the flushing data <generating step>.

Next, the CPU 12 judges whether or not the process has been finished with respect to the target pages (step S220). Here, in a case in which the process has not been finished with respect to the target pages (No in step S220), the CPU increases the page count (step S222) and proceeds to step S200. As a result of this, step S200 and subsequent processes are executed to the $(J+1)^{th}$ page as the target. On the other hand, in a case in which the process has been finished with respect to the target pages (Yes in step S220), a series of processes are finished. In this manner, when printing of the $J^{th}$ page is finished, similar processes are subsequently executed to the $(J+1)^{th}$ page, and print processes of the N pages instructed by the job data are executed.

According to the above-described embodiment, the following effects are achieved.

(1) In a case in which the print target image of the $J^{th}$ page is printed by monochrome and the print target image of the next $(J+1)^{th}$ page is subsequently printed by color, the second flushing of the $J^{th}$ page onto the paper P is conducted using color ink. Therefore, increase in the viscosity of color ink in the nozzle 22 can be reduced, and the print quality of the print target image of the next $(J+1)^{th}$ page can be prevented from being deteriorated.

(2) In a case in which the print target image of the $J^{th}$ page is printed by monochrome and the print target image of the next $(J+1)^{th}$ page is subsequently printed also by monochrome, the second flushing of the $J^{th}$ page onto the paper P is conducted using the K ink. Therefore, color ink that is not used for printing in the $(J+1)^{th}$ page is not wasted by using for the second flushing, and the ink amount to be consumed can be reduced.

(3) In a case in which the second flushing using color ink is not conducted for a prescribed period of time, even if pages of monochrome printing continue, the second flushing using color ink is conducted. It is thus possible to prevent printing from being interrupted by conducting the first flushing between pages among continuous pages that are being sequentially printed. Therefore, print job data that instructs printing to a plurality of pages can be efficiently executed.

(4) The dot patterns expressed on the paper P by the second flushing in the case of monochrome printing and in the case of color printing are the same. Further, the C ink, the M ink, the Y ink, and the K ink are observed as black color by being ejected to be superimposed at the same position. Therefore, even in a case in which there are both pages of monochrome printing and color printing, the dot patterns by the second flushing are the same and both are black color, so that a sense of discomfort will not be given.

A device for implementing the above-described technique includes various kinds of embodiments. There are cases in which it is achieved by a single device, and there are cases in which it is achieved by combining a plurality of devices. Each configuration of each embodiment and the combination thereof are examples, and changes such as addition, omission or replacement of the configuration can be made without departing from the subject matter of the present invention. The present invention is not limited to the embodiments, and is limited only to the scope of claims.

What is claimed is:

1. A printing device comprising:

at least one head having a plurality of nozzles configured and arranged to eject a plurality of kinds of ink;

a driving mechanism configured and arranged to move at least one of a printing medium and the head so as to relatively change positions of the printing medium and the head; and a control section configured to control operation of forming image forming dots for printing an image designated as a print target and flushing dots other than the image forming dots on the printing medium by ejecting the ink from each of the nozzles while relatively changing the positions of the printing medium and the head by the driving mechanism, wherein the control section has a print instruction receiving section configured to receive print instructions to the printing medium including a plurality of pages, and an ink use analyzing section configured to analyze the image forming dots formed on each page of the plurality of pages and to output each of ink use information and ink non-use information for each page, the ink use information and the ink non-use information showing which ink is used and which ink is not used among the plurality of kinds of ink in each page, and when the print instruction receiving section receives the print instructions over the plurality of pages, the control section is configured to acquire the ink non-use information of a given first page of continuous pages of the plurality of pages and the ink use information of a second page that is a next page of the first page from the ink use analyzing section, and to determine to use ink, that is not used in the first page shown by the ink non-use information and is used in the second page shown by the ink use information, at least for the flushing dots to the first page.

2. The printing device according to claim 1, wherein when the print instruction receiving section receives the print instructions over the plurality of pages, the control section is further configured to acquire the ink use information of the first page and the ink non-use information of the second page from the ink use analyzing section, and to determine not to use ink, that is not used in the second page shown by the ink non-use information, for the flushing dots to the first page in a case in which the ink used in the first page and the ink used in the second page shown by the ink use information are the same, and to determine to use ink, that is not used in the first page shown by the ink non-use information and is used in the second page shown by the ink use information, at least for the flushing dots to the first page in a case in which the ink used in the first page and the ink used in the second page shown by the ink use information are not the same.

3. The printing device according to claim 1, wherein the plurality of kinds of ink includes achromatic ink and chromatic ink, and the image forming dots are formed on the first page by the achromatic ink and not by the chromatic ink.

4. The printing device according to claim 1, wherein in a case in which there is ink that is not ejected from the nozzles for a prescribed period of time in the continuous pages among the plurality of kinds of ink, the control section is configured to determine to use the ink, that is not ejected from the nozzles for the prescribed period of time, at least for the flushing dots to the first page irrespective of the ink use information and the ink non-use information from the ink use analyzing section.

5. The printing device according to claim 1, wherein the plurality of kinds of ink includes cyan ink, magenta ink, and yellow ink, and the control section is configured to cause the flushing dots to be formed by superimposing the cyan ink, the magenta ink, and the yellow ink at the same position in a case in which the control section determines to use the cyan ink, the magenta ink, and the yellow ink for the flushing dots.

6. The printing device according to claim 1, wherein the control section is configured to make a dot pattern of the flushing dots formed on the first page and a dot pattern of the flushing dots formed on the second page the same at least in a prescribed area of the first and second pages.

7. A method for controlling a printing device including at least one head having a plurality of nozzles for ejecting a plurality of kinds of ink, a driving mechanism configured and arranged to move at least one of a printing medium and the head so as to relatively change positions of the printing medium and the head, and a control section configured to control operations of forming image forming dots for printing an image designated as a print target and flushing dots other than the image forming dot on the printing medium by ejecting the ink from each of the nozzles while relatively changing the positions of the printing medium and the head by the driving mechanism, the method for controlling a printing device comprising:

receiving print instructions to the printing medium including a plurality of pages; and analyzing ink use by analyzing the image forming dots formed on each page of the plurality of pages and outputting each of ink use information and ink non-use information for each page, the ink use information and the ink non-use information showing which ink is used and which ink is not used among the plurality of kinds of ink in each page, wherein the analyzing the ink use includes, when receiving the print instructions over a plurality of pages, acquiring the ink non-use information of an given first page of continuous pages of the plurality of pages and the ink use information of a second page that is a next page of the first page, and determining to use ink, that is not used in the first page shown by the ink non-use information and is used in the second page shown by the ink use information, at least for the flushing dots to the first page.

* * * * *